United States Patent [19]

Murray

[11] Patent Number: 4,655,491

[45] Date of Patent: Apr. 7, 1987

[54] LUMINAIRE LATCH

[75] Inventor: Omer E. Murray, Hendersonville, N.C.

[73] Assignee: General Electric Company, Schenectady, N.Y.

[21] Appl. No.: 860,399

[22] Filed: May 7, 1986

Related U.S. Application Data

[63] Continuation of Ser. No. 600,742, Apr. 14, 1984, abandoned.

[51] Int. Cl.[4] ..... E05C 19/14

[52] U.S. Cl. ..... 292/247; 16/382; 24/71 R; 292/DIG. 49; 292/DIG. 53; 292/DIG. 61; 292/DIG. 64; 403/330

[58] Field of Search ..... 292/246–250, 292/DIG. 49, DIG. 53, DIG. 16, 113, DIG. 17, DIG. 61, DIG. 64; 24/270, 70 SK, 71 SK, 71 T, 71 R, 69 R; 403/330; 16/382, 252

[56] References Cited

U.S. PATENT DOCUMENTS

| | | | |
|---|---|---|---|
| 498,472 | 5/1893 | Hunter | 292/246 |
| 1,022,575 | 4/1912 | Beehler | 292/246 |
| 1,042,511 | 10/1912 | Watrous | 292/247 |
| 1,350,713 | 8/1920 | Ferdon | 292/247 |
| 1,512,142 | 10/1924 | Sessions | 292/250 |
| 2,474,397 | 6/1949 | Henne | 292/3 X |
| 3,025,094 | 3/1962 | Buchanan . | |
| 3,654,453 | 4/1972 | Jablonski | 292/247 X |
| 4,023,840 | 5/1977 | Souza et al. | 292/DIG. 38 X |
| 4,164,804 | 8/1979 | Fletcher . | |
| 4,381,656 | 5/1983 | Hayakawa | 70/370 X |
| 4,426,676 | 1/1984 | Taylor . | |
| 4,512,122 | 4/1985 | Berkowitz | 292/DIG. 38 X |

*Primary Examiner*—Robert L. Wolfe
*Assistant Examiner*—Lloyd A. Gall
*Attorney, Agent, or Firm*—John P. McMahon; Philip L. Schlamp; Fred Jacob

[57] ABSTRACT

A two-part latch comprising hinged bail and crank for latching a globe and ring assembly to a fixed housing requires no screws, rivets or similar discrete fastening means. The crank member is a rectangular link formed from a length of resilient wire having its ends butted together at a split near the middle of one side. It is inserted into a captivating recess in which a pair of side ramps and a cut-off center ramp engage opposite faces of the link and cause the portions on each side of the split to twist and snap back after passing beyond the cut-off, whereby the crank is permanently captivated in a hinged attachment.

6 Claims, 6 Drawing Figures

LUMINAIRE LATCH

This is a continuation of application Ser. No. 600,742, filed Apr. 14, 1984, now abandoned.

This invention relates to a latch, that is, a hand-manipulated separable fastener for luminaires of the type comprising a fixed housing and a hinged portion or assembly which can be swung open to give access to the interior for servicing.

BACKGROUND OF THE INVENTION

In order to have convenient access to the lamp within the fixed housing of a luminaire, it is common to hinge one side of the light-transmitting bowl or globe assembly to the housing and to provide latch means at the other side. When locked the latch means holds the globe assembly in its closed position, and when released, allows the bowl assembly to swing down to an open position giving access to the interior of the optics compartment. While it is common to speak of a globe, the term is loosely used to mean not only a bowl-shaped light-transmitting closure whether faceted or not, but any lens or closure including a simple clear flat plate serving primarily as a window to keep out dirt and water.

Street lighting and industrial luminaires of the foregoing type are usually mounted at such heights that a ladder or elevated platform is used for servicing. For convenience and safety, a hinge and latch arrangement capable of being opened and closed by one hand, leaving to the workman his other hand free for supporting himself, is commonly provided.

SUMMARY OF THE INVENTION

The object of the invention is to provide an improved latch suitable for the foregoing application and which is simple and rugged in construction, has a minimum number of parts, is economically manufactured and easily installed, and is readily manipulated to give a secure fastening of the parts. In particular, latching means requiring no screws, rivets or similar discrete fastening means for attachment to the luminaire globe ring is sought.

A two-part latch embodying the invention comprises a bail member and a crank member both made of resilient wire. The bail member is a double-tined elongated wire link having a transverse bight which engages a strike portion in the fixed housing of the luminaire. The ends of the tines are hingedly attached to one end of the crank member which is a generally rectangular wire link pivotally fastened to the globe ring at its other end. The crank member is a length of wire whose ends meet at a split midway in one side and it is attached to the globe ring by pushing the split end into a cavity formed in the globe ring. The cavity walls comprise a pair of side ramps defining one plane and a cut-off center ramp defines a second plane converging with the first. As the crank member is forced in, the wedging action of the ramps causes the arms of the crank member on each side of the split to twist in order to pass over the center ramp. Upon passing beyond the terminus of the center ramp, the arms snap back and the crank is permanently captivated in a hinged attachment to the globe ring.

DETAILED DESCRIPTION

Figure 1:
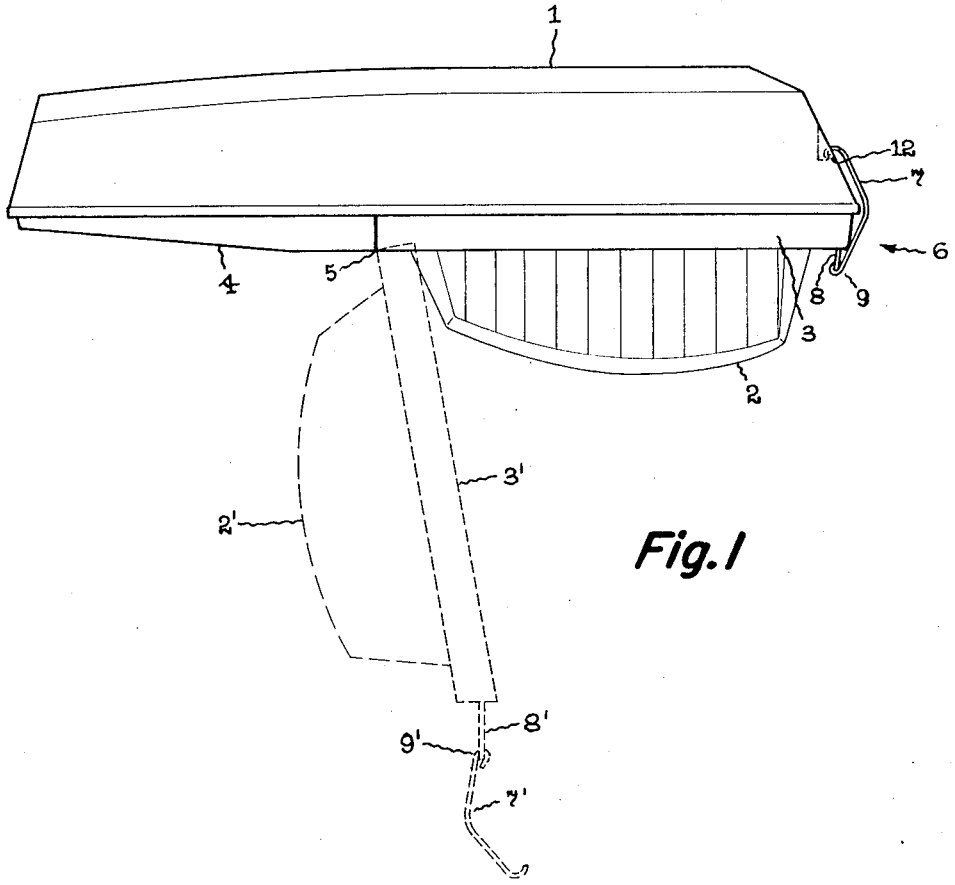
FIG. 1 is a side view of a street lighting luminaire equipped with a latch embodying the invention.

Referring to the drawings and particularly to FIG. 1, the illustrated street lighting luminaire comprises a fixed upper housing 1 whose underside is closed at the front by a globe 2 supported in a globe ring or frame 3 and at the rear by a door 4. The housing may be a light-weight aluminum die casting, suitably from 0.065" to 0.095" in wall thickness. The ballast components for operating a high intensity discharge lamp may be fastened to the inside of the door in an arrangement which facilitates changeouts by replacing the entire door. The luminaire has an opening at its rear (left side in the drawing) for receiving an elongated support member such as a pipe extending generally horizontally from a pole or other vertical support. The pipe is accommodated in conventional fashion in a slipfitter (not shown) within the rear of the housing which allows adjustment in mounting attitude.

The globe ring 3 is hinged at 5 and may be swung down as indicated at 3' by releasing over-center latch assembly 6 to give access to the lamp in the optics compartment (not shown). The latch comprises two principal moving parts, bail member 7 and crank member 8, both made of stiff resilient wire, suitably stainless steel. The bail member is hinged about limb 9 of the crank, and the latch is released by grasping it at the hinge and pulling away from the globe, that is to the right as seen in FIG. 1. Thereafter the transverse bight 11 of the bail member is unhooked from the hook or strike portion 12 in the front wall of the upper housing and the globe allowed to swing down as indicated at 2'. The hook or strike portion may be merely an upstanding ridge along the front of a recess formed in the aluminum die casting.

Figure 3:
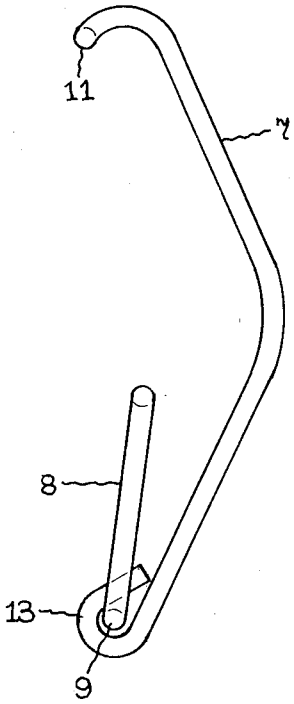
FIG. 3 is a side view of the latch assembly.
Figure 2:
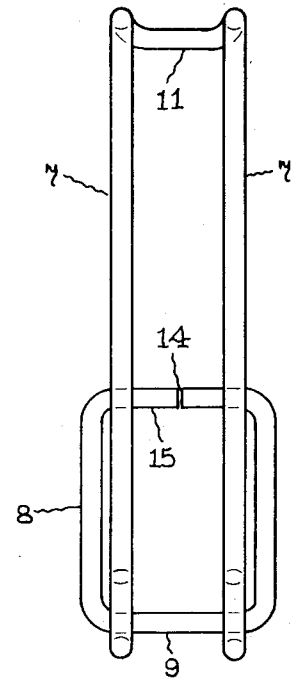
FIG. 2 is a front view of the latch assembly.

The bail member 7 is a double-tined elongated wire link having a transverse bight 11 best seen in FIG. 2. Viewed as shown in FIG. 3 in the plane in which it swings or pivots, the bail member is curved or bowed and the transverse bight 11 terminates in a more sharply curved or hooked end portion. The rolled ends 13 of the tines are looped around the lower transverse portion or limb 9 of crank member 8 to make a pivotal attachment. The crank member is a length of wire bent through 4 right angles to form a rectangular link. The ends of the wire butt together at a split 14 about midway in the upper transverse portion 15 but are not welded or fastened together at the split.

Figure 4:
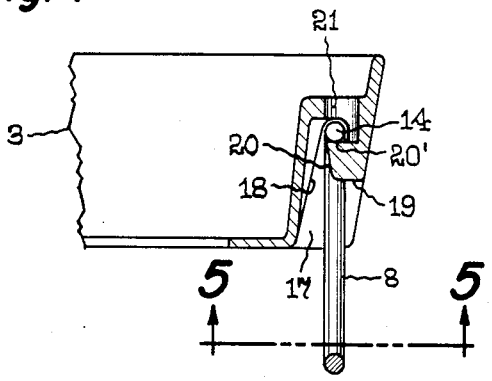
FIG. 4 is a side section detail through the crank cavity.
Figure 5:
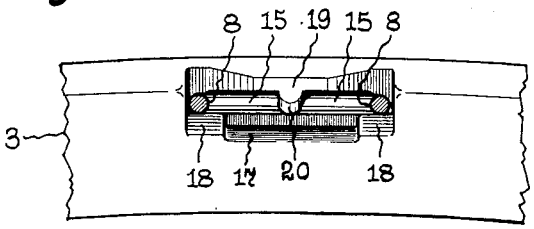
FIG. 5 is a bottom view detail looking up into the crank cavity in the direction of the arrows 5—5 in FIG. 4 after rotating the cavity 90° about a vertical axis. The crank member is shown pushed home and fully inserted.
Figure 6:
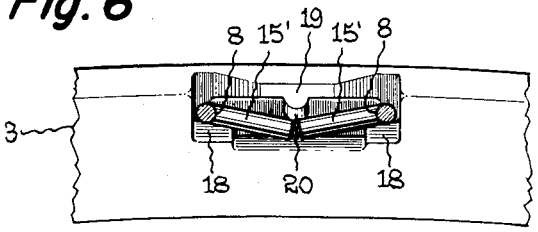
FIG. 6 is a view similar to FIG. 5 showing the crank member partly inserted only.

The invention concerns particularly the manner of effecting a hinged or swinging attachment of crank member 8 to the globe ring without use of screws, rivets or discrete fasteners. The globe ring 3 is an aluminum die casting and is formed with a captivating recess or cavity 17 at the midpoint of the front side as best seen in FIG. 4. The face wall of the recess comprises a pair of side ramps 18 defining one plane. A depending wedge portion 19 comprises a cut-off center ramp 20 on its inside face which defines a second plane converging with the first. As transverse portions 15 of crank member 8 are forced into the cavity, the side ramps 18 engage one face of the portions at the sides and center ramp 20 engages the opposite face at the center. The wedging action of the ramps develops torsion causing the arms of the crank member on each side of split 14 to twist as shown at 15' in FIG. 6 in order to pass over the center ramp. Upon passing beyond the terminus 20' of the center ramp, the arms snap back to their normal stance as shown in FIGS. 4 and 5. As a result, the crank is permanently captivated in a pivotal attachment to the globe ring.

The invention thus provides a latch which requires no extra parts such as screws or rivets and washers etc. for attachment to a casting. The captivating cavity in the housing casting introduces no producibility problem since it fills easily and does not require secondary trimming. The undercut 21 for cutting off and terminating the center ramp at 20' requires just a round pin insert at casting which is easy to maintain. As regards ease of assembly, the design is well nigh optimum since all that is required to attach the latch assembly to the luminaire housing is a single push-in motion. Trimming is not required because flash in the rearward facing slot is not visible and the snap back of the crank member arms clears away any that might occur. The appearance is of course superior to that of designs where attachment hardware is exposed and visible.

While the invention has been described with reference to a particular embodiment thereof used with a street or roadway luminaire for globe latching, it will be understood that various modifications may be made by those skilled in the art without departing from the invention. The latch of the invention may of course be used for latching other principal parts, particularly when one of those parts is a die casting which permits the molding of the required captivating cavity. The appended claims are intended to cover all such equivalent variations coming within the true spirit and scope of the invention.

What I claim as new and desire to secure by Letters Patent of the United States is:

1. Latching means for detachably connecting a first principal part of a luminaire to a second principal part of a luminaire including in combination:

a latch device having first and second ends;

said first principal part having a strike portion carried therein, said first end of said latch device adapted to engage said strike portion;

said second principal part having a captivating recess carried therein for accommodating said second end of said latch device in a hinged attachment;

said second end of said latch device having at least one deflectable arm, said one arm including a pair of opposed faces;

said captivating recess having deflecting means for engaging each of said opposed faces for deflecting said deflectable arm of said second end of said latch device upon insertion of said second end into said recess; and said recess further including terminus means for preventing withdrawal of said second end from said recess, said terminus means permitting said deflectable arm to return toward its undeflected stance after passing beyond the terminus means whereby the second end of said latch device is disposed in an overlapping relationship with said terminus means to permanently captivate said latch device in a hinged attachment to said second principal part.

2. Latching means for detachably connecting two principal parts together including in combination:

a latch device comprising a bail member and a crank member, a principal part having a strike portion, and another principal part having a captivating recess for accommodating one end of said crank member in a hinged attachment, said bail member having at one end a hook portion adapted to engage said strike portion and at the other a hinged attachment to one end of said crank member, said crank member being formed from a length of resilient wire bent so that its ends butt at a split near the middle of a transverse portion at the other end of said crank, said captivating recess having a face wall with a pair of side ramps defining a first plane, and a wedge portion having a cut-off center ramp facing said face wall and defining a second plane converging with the first, said pair of ramps and said center ramp engaging opposite faces of said crank member and causing its portions on each side of said split to twist as the member is forced into the recess, and the cut-off in the center ramp allowing the transverse portions on each side of the split to snap back after passing beyond the cut-off whereby the crank is permanently captivated in a hinged attachment to said another principal part.

3. Latching means as in claim 1 wherein the bail member is a bowed double-tined elongated wire link having a transverse bight forming the hook portion.

4. Latching means as in claim 1 wherein the crank member is a length of wire bent through 4 right angles to form a rectangular link, and the ends of the wire butt together near the middle of one end.

5. Latching means as in claim 4 wherein the bail member is a bowed double-tined elongated wire link having a transverse bight forming the hook portion and the ends of the tines are looped around said one end of the crank member to make a hinged attachment.

6. A luminaire comprising latching means as in claim 1 for latching a hinged globe and ring assembly to a fixed housing wherein the strike portion is in the fixed housing, and the captivating recess in which the crank member is hingedly attached is formed in the globe ring.

* * * * *